United States Patent [19]

Tilghman

[11] 4,424,643

[45] Jan. 10, 1984

[54] TOY PARACHUTE RELEASE MECHANISM

[76] Inventor: Bill M. Tilghman, 5604 W. Palo Verde Ave., Phoenix, Ariz. 85302

[21] Appl. No.: 336,557

[22] Filed: Jan. 4, 1982

Related U.S. Application Data

[63] Continuation of Ser. No. 206,472, Nov. 13, 1980, abandoned.

[51] Int. Cl.[3] ..... A63H 33/20; B64C 31/06; F41J 9/08

[52] U.S. Cl. ..... 46/86 R; 244/155 R

[58] Field of Search ..... 46/86 R, 86 A, 86 B, 46/86 C, 74 R; 244/155 R, 155 A, 153 R

[56] References Cited

U.S. PATENT DOCUMENTS

| | | | |
|---|---|---|---|
| 2,927,753 | 3/1960 | Feldman | 46/86 R |
| 3,209,487 | 10/1965 | Fisher | 46/86 R |
| 3,513,591 | 5/1970 | Hansen | 46/86 R |
| 3,582,026 | 6/1971 | Giolitto | 46/86 R |
| 3,768,762 | 10/1973 | George | 244/155 R |
| 3,960,347 | 6/1976 | Stritzke | 244/155 R |
| 4,226,388 | 10/1980 | Tilghman | 244/155 R |

*Primary Examiner*—Gene Mancene
*Assistant Examiner*—Michael J. Foycik
*Attorney, Agent, or Firm*—Drummond, Nelson & Nissle

[57] ABSTRACT

An improved release mechanism for detachably connecting a secondary flight device to a toy parachute which is attached to a kite string and which is then, after traveling up the string with the wind, released from the string for free flight to the ground. The release mechanism includes a first member and a second member. The second member is shaped, contoured and dimensioned to detachably receive the first member. The toy parachute carries one of the members and the secondary flight device carries the other of the members, the members being maintained in engagement by the force of gravity acting on the secondary flight device when the toy parachute is engaging the kite string. The first member separates from the second member when the toy parachute is released from the kite string such that the secondary flight device and toy parachute separately free flight to the ground.

1 Claim, 7 Drawing Figures

TOY PARACHUTE RELEASE MECHANISM

This application is a continuation of Ser. No. 06/206,472, filed Nov. 13, 1980, and now abandoned.

This invention relates to toy parachutes.

More particularly, the instant invention relates to toy parachutes which are attached to a string and which are then, after traveling up the string with the wind, released from the string for free flight to the ground.

In a further and more specific respect, the invention relates to a toy parachute of the type described having a secondary flight device which engages the toy parachute while the toy parachute travels up a kite string and which, after the toy parachute is released from the kite string, separates from the toy parachute such that both the secondary flight device and toy parachute separately free flight to the ground.

In still another respect the invention pertains to a release mechanism having a pair of members which detachably engage one another, one of the pair being attached to a toy parachute of the type described and the other of the pair being attached to a secondary flight device.

In yet another respect, the invention concerns a release mechanism of the type described in which the member pair is generally maintained in engagement by the force of gravity while the toy parachute travels up a kite string with the wind and then, when the toy parachute is released from the string, parts such that the secondary flight device and toy parachute separately descend to the ground.

Toy parachutes which are attached to a kite string and travel up the string with the wind to be released from the string for free flight to the ground have long been known. Providing such a toy parachute with a second flight device which separates from the toy parachute when the toy parachute is released from the string is also well known in the art. See for example U.S. Pat. Nos. 3,768,762 to George and 4,226,388 to Tilghman.

In the George patent, the secondary flight device is connected with the primary toy parachute by means of an eyelet-hook combination. When the toy parachute is traveling up the kite string (See FIG. 6 of George), the pulley member riding the string maintains the weight and hook attached to the weight in an attitude which prevents the eyelet from sliding off of the hook. Once the toy parachute is released from the string, the weight and hook assume their normal upright position beneath the parachute and the eyelet slides off of the hook such that the toy parachute and flight device separate and float to the ground.

Although the eyelet-hook combination disclosed in the George patent is of simple construction, there are generally two problems associated with this particular release mechanism. First, the eyelet is free to rotate in a 360° circle about the leg of the hook carrying the eyelet. As a result, during sudden gusts of wind the secondary flight device may be upwardly blown toward and foul the primary toy parachute or foul the kite string. Second, when, as is the case in the George patent, the weight carried by the primary parachute is free to rotate upwardly to a nearly normal vertical position, a gust of wind may consequently cause the weight and attached hook to assume a nearly normal upright position, causing the eyelet to prematurely disengage from the hook.

Accordingly, it would be highly desirable to provide an improved release mechanism which would interconnect a toy parachute of the type described with a secondary flight device and which would maintain the secondary flight device in a relatively fixed attitude with respect to the weight of the primary toy parachute while the toy parachute traveled up a kite line.

It would also be highly desirable to provide such a release mechanism which would keep the secondary flight device and primary toy parachute attached to one another during gusts of wind which cause substantial variation in the attitude of the primary toy parachute and weight attached thereto.

Therefore, it is a principal object of the instant invention to provide an improved toy parachute of the type which is attached to a kite string and which is then, after traveling up the string with the wind, released from the string for free flight to the ground.

Another object of the instant invention is to provide an improved mechanism for detachably connecting a primary toy parachute of the type described above to a secondary flight device such that the toy parachute and secondary flight device remain attached to one another while the toy parachute travels up a kite string with the wind and then, after the primary toy parachute is released from the kite string, separate from one another and free flight to the ground.

A further object of the present invention is to provide a release mechanism which would detachably connect a toy parachute of the type described with a secondary flight device such that the secondary flight device maintained a relatively fixed position with respect to the weight of the primary toy parachute while the toy parachute traveled up a string with the wind.

These and other, further and more specific objects and advantages of the invention will become apparent from the following detailed description thereof, taken in conjunction with the drawings, in which.

Figure 1:
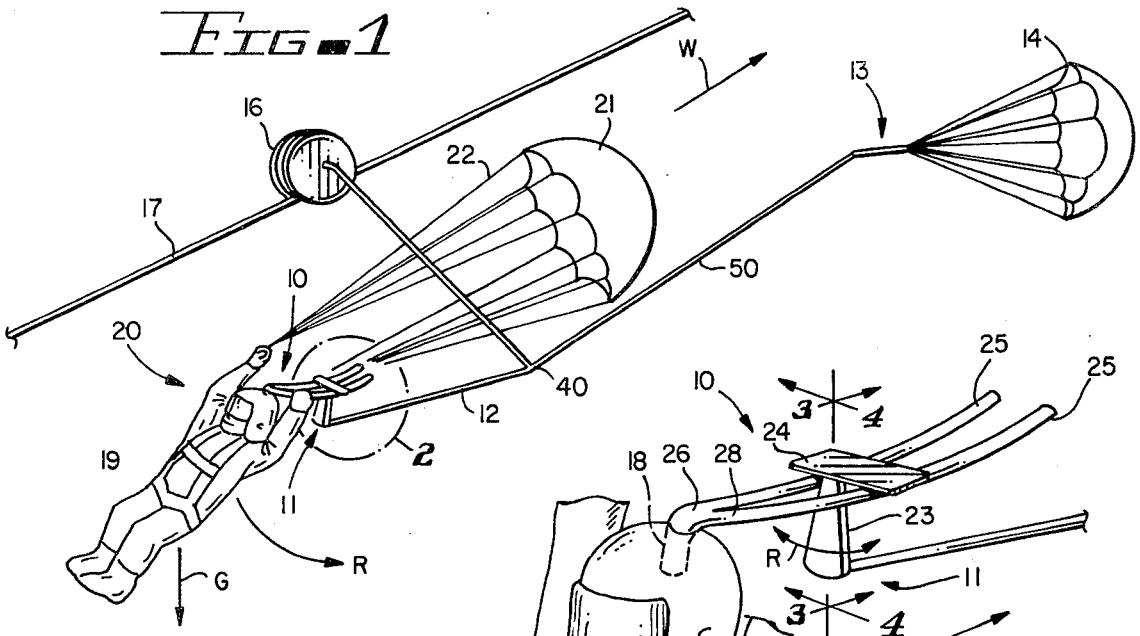
FIG. 1 is a perspective view of a pair of toy flight devices detachably connected to one another by the presently preferred embodiment of the release mechanism of the invention.
Figure 2:
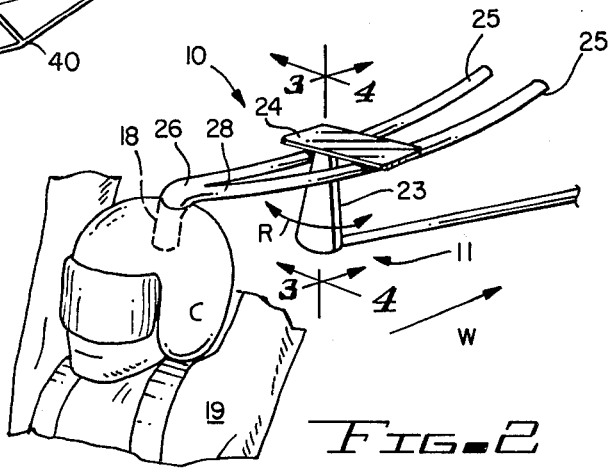
FIG. 2 is an enlarged perspective view of the release mechanism of FIG. 1.
Figure 3:
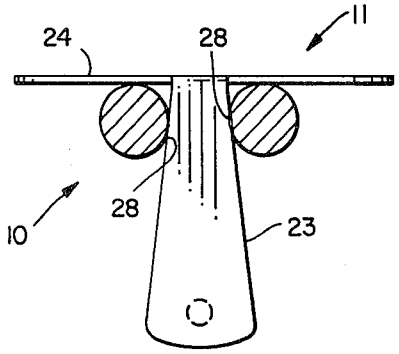
FIG. 3 is a front sectional view of the release mechanism of FIG. 2 taken along section line 3—3 thereof.

Briefly, in accordance with my invention, I provide an improved toy parachute for being attached to a kite string and for, after traveling up the string with the wind, being released from the string for free flight to the ground. The toy parachute includes a weight; a parachute having a canopy and a plurality of shroud lines, the shroud lines being separately attached to the canopy at their upper ends and attached to the weight at their lower ends; and, carrier means connected to the weight for releasably movably engaging the kite string. The improvement in the toy parachute comprises a flight device comprising at least one member having surfaces generally shaped, contoured and dimensioned such that movement of the flight device through the air provides aerodynamic lift for the device; means for operatively detachably connecting the flight device to the toy parachute, the connecting means comprising a pair including a first member and a second member shaped, contoured and dimensioned to detachably receive the first member; the toy parachute carrying one of the member pair and the flight device carrying the other of the member pair; the pair being maintained in engagement by the force of gravity acting on the flight device when the carrier means is engaging the string and separating when the carrier means is released from the string so that the flight device and toy parachute separately free flight to the ground. When the member pair engage one another, the force of gravity upwardly forces one of the members against the other of the members.

Turning now to the drawings, which depict the presently preferred embodiments of the invention for the purpose of illustrating the practice thereof and not by way of limitation of the scope of the invention, and in which like reference characters represent corresponding elements throughout the several views, FIGS. 1–5 illustrate the presently preferred embodiment of the invention including primary toy parachute and secondary flight toy respectively indicated by reference characters 13, 20 and interconnected by a release mechanism having a pair of members generally indicated by reference characters 10, 11. Primary toy parachute 13 includes parachute 14 carrying weight 15 connected to pulley wheel carrier means 16 which movably engages kite string 17. Secondary flight toy 20 comprises parachute 21 and shroud lines 22 interconnecting parachute 21 and weight 19. Substantially rigid wire 12 connects member 11 to primary toy parachute 13. The projection represented by dashed lines 18 of member 10 is fixedly secured in an aperture formed in weight 19 of secondary flight toy 20. Weights 19, 15 and wire 12 are normally substantially rigid.

V-shaped member 10 includes elongate rails 25 attached at joint 26 and diverging therefrom. Upwardly tapered throat 23 of T-shaped member 11 is provided with outwardly projecting panel member 24. As is depicted by dashed lines 27 in FIG. 5, throat 23 is also transversely tapered toward the neck 28 of V-shaped member 10.

Figure 4:
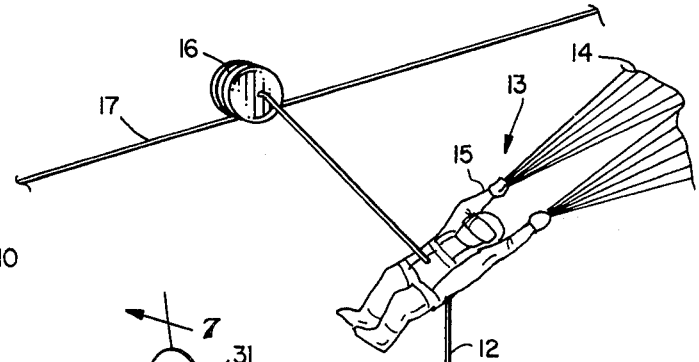
FIG. 4 is a side sectional view of the release mechanism of FIG. 2 taken along section line 4—4 thereof and further illustrating construction details thereof.
Figure 4:
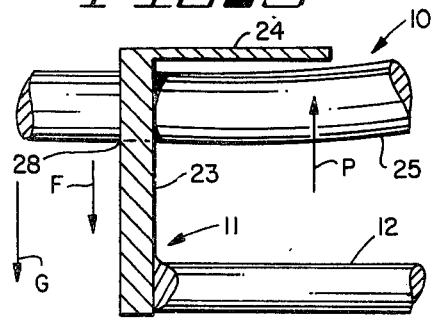

In use, members 10, 11 are slid together and carrier means 16 placed on a string. When carrier means 16 of primary toy parachute 13 is movably engaging string 17 and traveling up string 17 with the wind, secondary flight toy 20 is releasably interconnected with primary toy parachute 13 by members 10, 11. As illustrated in FIGS. 1 and 4, when toy parachute 13 is traveling up string 17 with the wind, the force of gravity, indicated by arrow G, acting on weight 19 of flight toy 20 interlocks members 10, 11. In effect, memebers 10, 11 interact as a lever-fulcrum pair, with throat 23 of member 11 acting as a fulcrum to support lever members 25 of member 10 at points 28. Gravity forces rigid rails or lever members 25 against tapered throat 23 as indicated by arrow F and upwardly against panel member 24 as represented by arrow P. Both the upward taper of throat 23 and the tapering of members 25 toward joinder point 26 prevent member 10 from sliding down throat 23.

While flight toys 13, 20 are moving up string 17 with the wind in the direction shown by arrow W, interlocking members 10, 11 tend to maintain weight 19 in a relatively fixed position with respect to weight 15 of primary toy parachute 13. Elements 23 and 24 of member 11 prevent member 10 and weight 19 from rotating in the direction of arrow R in response to forces generated when wind W impinges on weight 19, while the transverse taper 27 interlocks throat 23 of member 10 with the inner surfaces of rails 25 of V-shaped member 10 to prevent rotation of flight toy weight 19 about member 11 in the directions indicated by arrows S. These restrictions in the movement of weight 19 while flight toy 20 moves up the string with toy parachute 13 minimizes the likelihood toy 20 will foul parachute 14 of flight toy 13 or will become entangled with string 17.

When carrier means 16 is released from string 17 and is pulled directly beneath parachute 14 by gravity, throat 23 assumes a generally horizontal position and the force of gravity acting on weight 19 causes rails 25 to downwardly slide from engagement with throat 23 and panel member 24 such that flight toys 13, 20 part and separately free flight to the ground.

Figure 6:
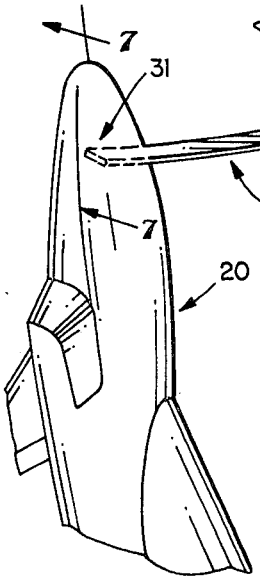
FIG. 6 is a perspective view showing a pair of toy flight devices detachably connected by an alternate embodiment of the release mechanism of the invention; and, FIG. 7 is an enlarged view of the release mechanism of FIG. 6.
Figure 5:
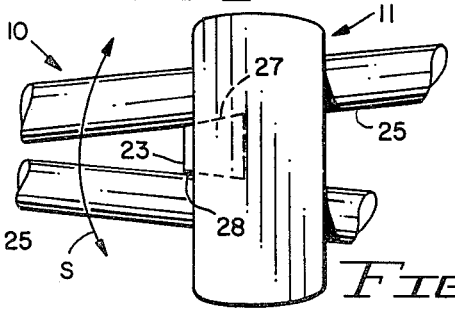
FIG. 5 is a top view of the release mechanism of FIG. 2.
Figure 7:
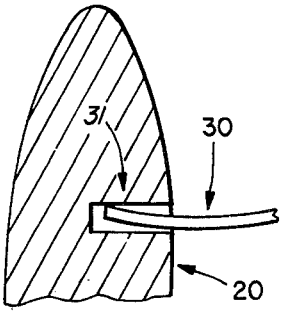

As would be appreciated by those of skill in the art, the member pair detachably connecting flight toys 13, 20 may be variously shaped, dimensioned and contoured so that gravity forces one of the members upwardly against the other during the movement of pirmary toy parachute 13 up string 17 with the wind. In this regard, FIGS. 6 and 7 illustrate an alternate embodiment of the invention in which member pair 30, 31 detachably interconnect flight toys 13, 20. Member 30 is comprised of an elongate, substantially rigid, rectangular member while member 31 is a rectangular aperture shaped and dimensioned to slidably receive member 30. When carrier means 16 is released from string 17 and weight 15 assumes its position beneath parachute 14, the elongate rectangular member 30 assumes a generally vertical position and gravity causes aperture 31 to slidably disengage from neck 30 so that flight toys 13, 20 separately float to the earth.

An important porblem encountered in the use of detachably connected flight toy pairs is that gusts of wind may cause the primary toy parachute 14 to be upwardly deflected such that members 10, 11 prematurely separate. I have discovered that when the center of gravity of the weight carried by the primary parachute is displaced away from the point at which the secondary flight toy is connected to the weight and toward the primary parachute, the primary flight toy is stabalized and is less susceptible to upward displacement by wind gusts. Thus, in FIG. 1, when weight 15 is constructed so that the center of gravity thereof is moved from point 40 to point 50, the likelihood of premature separation of flight toys 13, 20 is substantially reduced.

Having described my invention in such terms as to enable those skilled in the art to understand and practice it, and having identified the presently preferred embodiments thereof, I claim:

1. In combination with a toy parachute for being attached to a kite string and for, after traveling up said string with the wind, being released from said string for free flight to the ground, said toy parachute including, a weight, a parachute having a canopy and a plurality of shroud lines, said shroud lines being separately attached to said canopy at their upper ends and attached to said weight at their lower ends, and carrier means, connected to said weight, for releasably movably engaging said kite string, the improvement in said toy parachute comprising, (a) a flight device comprising at least one member having surfaces generally shaped, contoured and dimensioned such that movement of said device through the air provides aerodynamic lift for said device, (b) means for detachably connecting said flight device to said toy parachute, said connecting means comprising a fulcrum-lever pair including (i) an elongate lever member carried by said flight device and having a central portion, and first and second end sections each attached to said central portion of said lever member, (ii) a fulcrum member carried by said toy parachute and shaped to detachably receive said lever member, said lever member contacting said fulcrum member at at least a pair of points while said carrier means engages said kite string, (iii) a first point at which said central portion of said lever member contacts and turns about said fulcrum member, and (iv) a second point at which said second end section of said lever member contacts said fulcrum member, said fulcrum member and lever member being shaped and dimensioned such that (v) while said carrier means engages said kite string, the force of gravity acting on said flight device pulls said flight device and said first end section of said lever member downwardly and rotates said central section of said lever member about said fulcrum member, forcing said second end section of said lever member upwardly against said fulcrum member at said second point of contact to maintain said lever-fulcrum pair in engagement, and (vi) said lever-fulcrum pair separate when said carrier means is released from said string so that said flight device and said toy parachute separately free flight to the ground.

* * * * *